US005383764A

United States Patent [19]

Ogawa et al.

[11] Patent Number: 5,383,764

[45] Date of Patent: Jan. 24, 1995

[54] DIFFUSOR PUMP HAVING DIFFUSOR BLADES

[75] Inventors: Motoyasu Ogawa; Yuzo Nakagawa, both of Tokyo, Japan

[73] Assignee: Nikkiso, Co., Ltd., Tokyo, Japan

[21] Appl. No.: 29,735

[22] Filed: Mar. 11, 1993

[30] Foreign Application Priority Data

Mar. 11, 1992 [JP] Japan ..... 4-052503

[51] Int. Cl.[6] ..... F04D 1/08; F04D 29/44

[52] U.S. Cl. ..... 415/199.3; 415/199.2; 415/209.1

[58] Field of Search ..... 415/198.1, 199.1, 199.2, 415/199.3, 208.1, 208.2, 209.1, 211.2; 416/231 B

[56] References Cited

U.S. PATENT DOCUMENTS

| | | | |
|---|---|---|---|
| 1,622,930 | 3/1927 | Von Karman et al. | 416/231 B |
| 3,173,604 | 3/1965 | Sheets et al. | 415/209.1 |
| 4,981,414 | 1/1991 | Sheets | 415/149.1 |

FOREIGN PATENT DOCUMENTS

| | | | |
|---|---|---|---|
| 2185222 | 12/1973 | France . | |
| 101299 | 6/1983 | Japan | 415/209.1 |
| 61-65099 | 4/1986 | Japan . | |
| 181525 | 6/1922 | United Kingdom . | |
| 724803 | 3/1980 | U.S.S.R. | 416/231 B |

*Primary Examiner*—John T. Kwon
*Assistant Examiner*—James A. Larson
*Attorney, Agent, or Firm*—Young & Thompson

[57] ABSTRACT

The present invention provides a novel diffusor for a diffusor pump. The diffusor comprises a body having a side portion and a plurality of blades placed on the side portion of the body so as to be along a flow direction of a liquid, each of the plural blades including at least one aperture so as to divided into a plurality of parts. The body has a cylindrical shape. The blade is divided into first and second parts by a single aperture. The first part of the blade has a solidity in the range from 0.75 to 1.25 when the treating liquid flows from the first part to the second part.

5 Claims, 3 Drawing Sheets

DIFFUSOR PUMP HAVING DIFFUSOR BLADES

BACKGROUND OF THE INVENTION

The invention relates to a diffusor pump, and more particularly to a diffusor blade for a diffusor pump.

A normal diffusor pump includes diffusors with a plurality of blades forcing a liquid to exhibit a flow straightening. A liquefied natural gas immersed pump (a LNG immersed pump) is one of typical diffusor pumps. The liquefied natural gas immersed pump also includes the diffusors, each of which has a side face provided with a plurality of blades.

The structure of a normal LNG immersed diffusor pump will be described with reference to FIG. 1. The LNG immersed diffusor pump comprises a motor section and a pump section. The pump section of the LNG immersed diffusor pump comprises a plurality of stages, each of which includes an impeller 10 and a diffusor 12. The diffusor 12 is provided at its side portion with a plurality of blades 14. A liquid flows through the impeller 10 by which a rise of pressure of the liquid appears. After that, the liquid flows on the side portion of the diffusor 12 with the blades 14 and then transmitted to a next stage.

The structure of the conventional diffusor 12 with the blades 14 involved in the LNG immersed diffusor pump will subsequently be described with reference to FIG. 2. The diffusor 12 comprises a cylindrical-shaped body. The cylindrical-shaped diffusor 12 has a side portion which is provided with a plurality of the diffusor blades 14. The plural diffusor blades 14 are so arranged as to be in parallel to each other at a predetermined interval. Each of the diffusor blades 14 is further so arranged as to have a longitudinal direction along a desired flow direction of the liquid, because the longitudinal direction of each of the diffusor blades 14 defines a flow direction of the liquid. The arrangement of the diffusor blades 14 is thus symmetrical in the axial direction.

The diffusor blades 14 define the flow direction of the treating liquid on the side of the diffusor 12. The existence of the diffusor blades 14 forces the liquid flowing on the side of the diffusor 12 to exhibit a flow straightening. As a result, the flow rate of the liquid is reduced. Concurrently, a rise of pressure of the liquid appears. Namely, the diffusor blades 14 make the flow rate of the liquid decrease and cause the pressure rise of the liquid.

The conventional diffusor pumps, and particularly the LNG immersed diffusor pumps are, however, burdened with the following disadvantages in the flow of the liquid along the side portion of the diffusor 12. Under a normal condition, such axially symmetrical diffusor blades 14 accomplish the above mentioned effects of both increasing the pressure of the liquid and its forced flow straightening. Thus, when a discharge flow rate of the liquid is within a reference discharge flow rate range, such axially symmetrical diffusor blades 14 are able to exhibit excellent functions of pressure increase and flow straightening of the liquid. Under the normal state in the reference discharge flow rate range, there exists no problem in the flow of the liquid. However, if the liquid has a discharge flow rate below in the reference discharge flow rate range, the flow of the liquid in the vicinity of the diffusor blades 14 exhibits a revolution and a stall. The undesirable phenomenon of the revolution and the stall of the flow of the treating liquid causes an axial vibration of the diffusor 12. This makes the life-time of bearings of the diffusor 12 short. This also makes the Q-H property inferior thereby lowering the pump efficiency. In addition, when the revolution and the stall of the flow of the liquid appear, the hunting of the flow of the treating liquid also appears. The above mentioned undesirable phenomena are considerable in the LNG immersed diffusor pumps.

To prevent the above undesirable phenomenon in the flow of the liquid, it is required that the discharge flow rate of the treating liquid is so controlled as to be within the reference discharge flow rate range. In the prior art, the operation of such LNG immersed diffusor pump is restricted, if the discharge flow rate of the treating liquid is lower than a discharge flow rate at which the revolution and the stall of the treating liquid flow appear. Under such lower discharge flow rate, the diffusor pump is not operative. It is desirable to lower as much as possible a critical discharge flow rate at which the revolution and the stall occur so that the operative range of the discharge flow rate becomes wide. It is, therefore, required to develop novel diffusor blades of the diffusor pump, which are able to make the diffusor pump operative in a wide range of the discharge flow rate of the liquid.

SUMMARY OF THE INVENTION

Accordingly, it is a primary object of the present invention to provide a novel diffusor blade of a diffusor pump.

It is a further object of the present invention to provide a novel diffusor blade of a diffusor pump, which permits the diffusor pump to operate in a wide range of a discharge flow rate of a liquid.

It is a still further object of the present invention to provide a novel diffusor blade of a diffusor pump, which is able to reduce a critical discharge flow rate at which a revolution and a stall of a treating liquid flow occur.

The above and other objects, features and advantages of the present invention will be apparent from the following descriptions.

The present invention provides a novel diffusor for a diffusor pump. The diffusor comprises a body having a side portion and a plurality of blades placed on the side portion of the body so as to extend along a flow direction of a liquid, each of the plural blades including at least one aperture so as to be divided into a plurality of parts. The body has a cylindrical shape. The blade is divided into first and second parts by a single aperture. The first part of the blade has a solidity in the range from 0.75 to 1.25 when the treating liquid flows from the first part to the second part.

BRIEF DESCRIPTION OF THE DRAWINGS

Preferred embodiments of the present invention will hereinafter fully be described in detail with reference to the accompanying drawings.

PREFERRED EMBODIMENTS OF THE INVENTION

Figure 1:
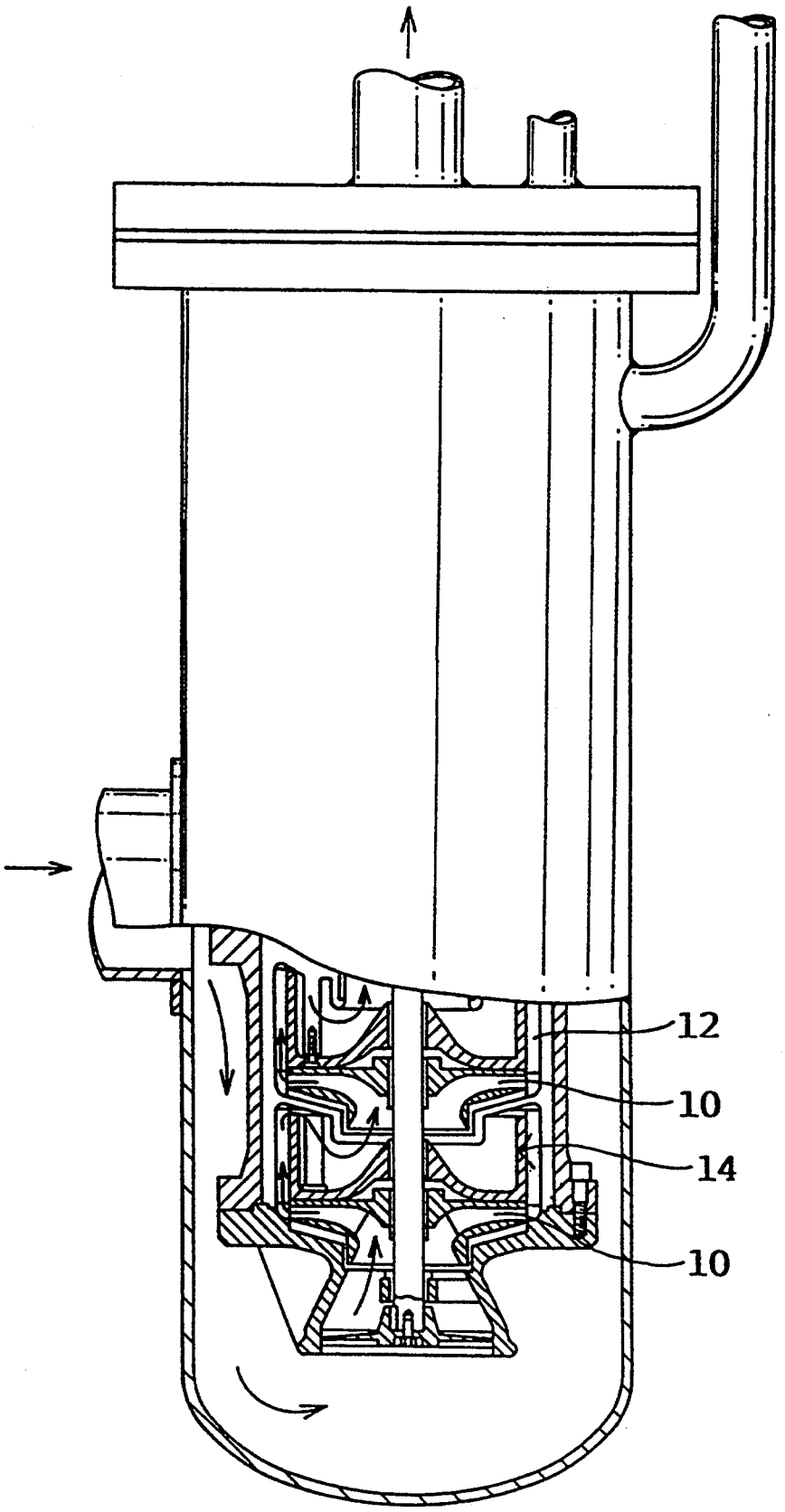
FIG. 1 PRIOR ART
FIG. 1 is an elevation view illustrative of the conventional LNG immersed diffusor pump.
Figure 2:
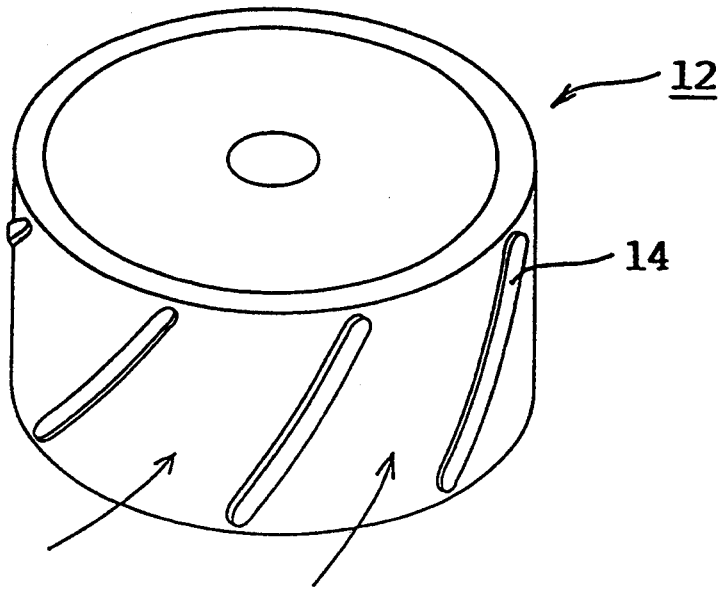
FIG. 2 PRIOR ART
FIG. 2 is a perspective view illustrative of the conventional diffusor with diffusor blades.
Figure 3:
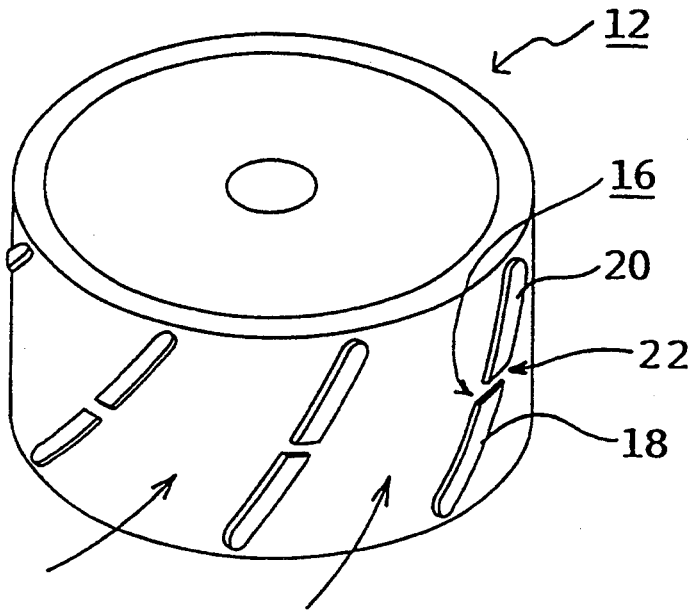
FIG. 3 is a perspective view illustrative of a diffusor with improved blades on a preferred embodiment according to the present invention.
Figure 4:
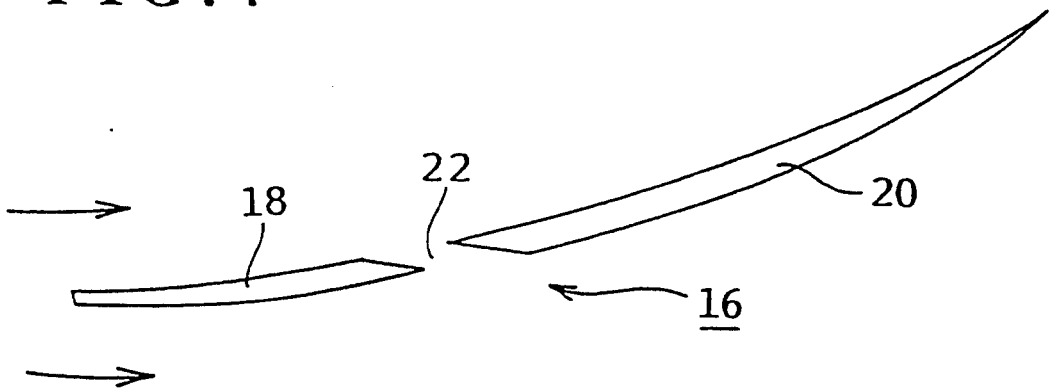
FIG. 4 is a view illustrative of a shape of an improved diffusor blade of a preferred embodiment according to the present invention.

A preferred embodiment of the present invention will be described with reference to FIGS. 3 and 4. The present invention provides an improved diffusor blade of a diffusor pump. A diffusor 12 comprises a cylindrical-shaped body. The cylindrical-shaped diffusor 12 has a side portion which is provided with a plurality of diffusor blades 16. The plural diffusor blades 16 are so arranged as to be in parallel to each other at a predetermined interval. Each of the diffusor blades 16 is further so arranged as to have a longitudinal direction along a desired flow direction of the liquid, because the longitudinal direction of each of the diffusor blades 16 defines a flow direction of the liquid. The arrangement of the diffusor blades 16 is thus symmetrical in the axial direction.

Each of the diffusor blades 16 comprises a dual diffusor blade and thus a first blade portion 18, a second blade portion 20 and an aperture 22. The aperture 22 is placed between the first and second blade portions 18 and 20 so that the diffusor blade 16 is divided into two portions and thus the first and second blade portions 18 and 20. Namely, the first and second blade portions 18 and 20 are spaced from each other by the aperture 22. Preferably, the first blade portion 18 of the diffusor blade 16 has a solidity in the range from 0.75 to 1.25.

The treating liquid flows along the longitudinal direction of the diffusor blade 16 from the first blade portion 18 to the second blade portion 20. In FIGS. 3 and 4, the flow direction of the treating liquid is represented by arrows. The flow direction of the liquid is defined by the diffusor blades 16 placed on the side portion of the diffusor 12. Namely, the flow of the liquid is subjected to a flow straightening. This results in that the liquid exhibits a reduction of a flow rate. Further, the liquid is subjected to pressure increase.

If the discharge flow rate of the liquid is relatively slow, the liquid flowing in the vicinity of the diffusor blade 16 is subject to a revolution and a stall. This is why the liquid is subjected to a flow straightening by the diffusor blade 16. This results in that the liquid flowing at a relatively slow rate along the first blade portion 18 of the diffusor blade 16 is also likely to exhibit a revolution and a stall of the flow due to the flow straightening forced by the diffusor blade 16. However, when the flow of the liquid approaches or reaches the aperture 22 of the diffusor blade 16, the existence of the aperture 22 makes the liquid become free from the forced flow straightening by the first blade portion 18 of the diffusor blade 16. As a result, the likelihood of revolution and stall of the liquid disappears. Thus, the existence of the aperture 22 allows the flow of the liquid to be free from the revolution and the stall. After that, the liquid flows along the second blade portion 20 of the diffusor blade 16. Although the liquid is again subjected to the forced flow straightening by the second blade portion 20 of the diffusor blade 16, the revolution and the stall of the flow of the liquid do not appear. This is why the likelihood of revolution and the stall of the flow of the liquid is sufficiently reduced by the aperture 22 of the diffusor blade 16.

Preferably, the second blade portion 20 is so positioned that the longitudinal center lines of the first and second blade portions 18 and 20 are slightly deflected from each other so as to prevent the liquid from flowing across the diffusor blade 16 through the aperture 22. This is represented in FIG. 4.

From the above description, it will be understood that the novel diffusor blade 16 having the aperture 22 provides the following advantages. The novel diffusor blade 16 having the aperture 22 is able to keep the liquid exhibiting a relatively slow flow from the revolution and the stall. This allows lowering considerably a critical discharge flow rate point where the liquid flow exhibits the revolution and the stall. This permits the diffusor pump including the improved diffusor blades 16 to be operative in a wide range of the discharge flow rate of the liquid. Namely, the novel diffusor pump is operative even if the liquid has a relatively low flow rate. Physically, when the second blade portion 20 of the diffusor blade 16 has a solidity of 1.0, the novel diffusor blade 16 reduces the inoperative flow rate range, in which the revolution and the stall occur, by up to 57%.

Further, the reduction of the critical discharge flow rate point by the novel diffusor blade 16 is able to prevent a liquid such as LNG from exhibiting hunting. Since the flow of the liquid is free from the revolution and the stall, an axial vibration of the diffusor pump does not appear thereby increasing the life-time of the bearing. The novel diffusor blade 16 is further able to improve the pump efficiency of the diffusor pump. It is also an advantage that the novel diffusor blade may readily be formed.

Although in the preferred embodiment the novel diffusor blade 16 is divided by the sole aperture 22 into the dual parts and thus the first and second blade portions 18 and 20, it is available as a modification that the diffusor blade is divided by two or more apertures into triple parts or more parts so as to match variable conditions.

Whereas modifications of the present invention will no doubt be apparent to a person having ordinary skill in the art, to which the invention pertains, it is to be understood that the embodiments shown and described by way of illustration are by no means intended to be considered in a limiting sense. Accordingly, it is intended to cover by the claims all modifications of the present invention which fall within the sprit and scope of the invention.

What is claimed is:

1. In a diffusor pump for a liquid, the pump comprising a plurality of stages each of which includes an impeller and a cylindrical diffusor, each cylindrical diffusor having on a cylindrical surface thereof a plurality of spiral blades; the improvement in which said blades have at least one gap intermediate their length whereby each blade is divided into a plurality of portions including a first portion and a second portion, the liquid flowing from said first portion to said second portion, and said first portion having a solidity in the range of 0.75 to 1.25, thereby to broaden the range of velocity of the liquid flowing through said pump at which the pump will be free from revolution of the liquid and stalling.

2. A pump as claimed in claim 1, wherein each said gap is bounded by straight parallel edges of said blade portions that are disposed at the same acute angle to the length of the blade.

3. A pump as claimed in claim 1, wherein said blade portions have longitudinal axes that are laterally displaced from each other for a same said blade.

4. A pump as claimed in claim 1, wherein said solidity is about 1.0.

5. A pump as claimed in claim 1, wherein said second portion has a solidity of about 1.0.

* * * * *